US006324793B1

(12) United States Patent
Klanke

(10) Patent No.: US 6,324,793 B1
(45) Date of Patent: Dec. 4, 2001

(54) BURIAL CRYPT

(76) Inventor: Michael Dean Klanke, 21715 Parkbend, Katy, TX (US) 77450

( * ) Notice: Subject to any disclaimer, the term of this patent is extended or adjusted under 35 U.S.C. 154(b) by 0 days.

(21) Appl. No.: 09/542,313

(22) Filed: Apr. 4, 2000

(51) Int. Cl.[7] ..... E04H 13/00

(52) U.S. Cl. ..... 52/124.2; 52/124.1; 52/125.4; 52/128; 52/135; 52/136; 27/1; 27/35

(58) Field of Search ..... 52/20, 21, 124.1, 52/124.2, 125.1, 125.4, 125.5, 128, 135, 136, 137, 169.6, 220.8, 583.1; 27/1, 7, 35

(56) References Cited

U.S. PATENT DOCUMENTS

| | | | | |
|---|---|---|---|---|
| 335,451 | * | 2/1886 | Hassard | 52/124.2 X |
| 828,199 | * | 8/1906 | Deck | 52/124.1 |
| 1,719,224 | * | 7/1929 | Hasse | 52/124.1 |
| 1,991,931 | * | 2/1935 | Kling et al. | 52/125.4 X |
| 2,886,370 | * | 5/1959 | Liebert | 52/125.3 X |
| 2,913,895 | * | 11/1959 | Blasius et al. | 52/137 |
| 3,078,621 | * | 2/1963 | Hinds | 52/99 |
| 3,230,674 | * | 1/1966 | Christensen | 52/127.1 |
| 3,958,378 | | 5/1976 | Omeechevarria . | |
| 4,064,664 | | 12/1977 | Gual . | |
| 4,102,098 | | 7/1978 | Duwe et al. . | |
| 4,597,692 | * | 7/1986 | Gruenwald | 404/25 |
| 4,974,992 | * | 12/1990 | Harter | 404/25 |
| 5,375,940 | * | 12/1994 | Kobayashi | 404/2 |
| 5,634,311 | * | 6/1997 | Carlton | 52/577 |
| 5,649,782 | * | 7/1997 | Frohlich et al. | 403/301 |
| 5,729,921 | | 3/1998 | Rojas . | |
| 5,746,030 | | 5/1998 | Sannipoli, Sr. . | |
| 6,176,317 | * | 1/2001 | Sepich | 166/379 |

OTHER PUBLICATIONS

Undated brochure from Whited Cemetery Service, titled Upright Marker Crypt.

* cited by examiner

*Primary Examiner*—Beth A. Stephan
*Assistant Examiner*—Brian E. Glessner
(74) *Attorney, Agent, or Firm*—Bracewell & Patterson LLP

(57) ABSTRACT

A crypt lid with lifting means for applying a vertical force to lift the lid is provided. The lid is preferably cast of concrete with one or more lifting holes extending vertically through the lid. The holes may be lined with a corrosion resistant material, such as a hard plastic, PVC, or other suitable material. The lining is preferably threaded, and sealing plug is adapted for threaded engagement with the lining of the holes. The plug is provided with a recessed drive receptacle and preferably fits flush with the surface of the crypt lid. This feature prevents damage to the plug, the lining, or the lid itself when a crypt is exhumed with heavy machinery like a backhoe. An easily removed privacy partition between upper and lower sections of the burial vault is also provided.

10 Claims, 3 Drawing Sheets

BURIAL CRYPT

FIELD OF THE INVENTION

The present invention relates generally to the field of cemetery crypts and, more particularly, to a cemetery crypt with easily removable lid and privacy partition in a multiple level vault.

BACKGROUND OF THE INVENTION

Double burial vaults typically provide a concrete enclosure deep enough to hold two caskets in vertically spaced chambers. Typically, particularly in national cemeteries, thousands of such vaults are placed side by side and row after row. Lids are placed on the vaults, and then earth is moved by heavy machinery to cover the vaults.

For the burial of a first body within a vault, the vault is first uncovered by removing the overlying earth and the lid is removed from the vault. This is the second time that the lid of the vault must be manipulated. The first casket is then lowered onto the bottom or floor of the vault. An intermediate floor is then lowered into the vault and seats on an intermediate ledge extending around the inner peripheral walls of the vault at the appropriate height. The lid is then placed back over the vault. At the time of the next interment, the lid is again removed, the second casket is lowered onto the intermediate floor, and the lid is once more placed over the vault. Even without subsequent exhumations, the represents a number of times that the lid must be lifted from and replaced onto the vault.

This arrangement suffers certain disadvantages since each of the lid and the intermediate floor is heavy and bulky. It is sometimes difficult to lower the intermediate floor flat into position in the vault without jamming or binding against the walls of the vault.

It is also difficult to lower the flat concrete floor into the vault, typically requiring two or more workers to lower it by hand.

Sannipoli, Sr., in U.S. Pat. No. 5,746,030, taught a burial crypt with guide grooves extending from the open end of the crypt toward the floor and terminating at a location corresponding to a desired intermediate floor height. A means was also provided for coupling a removal mechanism to horizontally extending recesses in the crypt lid to assist in the removal of the lid. Unfortunately, the ground in which the burial crypt is placed is invariably subject to subsidence, and the crypt lid and intermediate divider floor often become canted. This phenomenon jams the lid and intermediate floor in place, and makes the subsequent removal of the lid very difficult if a body is to be exhumed, and exhumations are surprisingly common. Further, the horizontally extending recesses formed in the crypt lid become filled with earth which hardens in place, rendering the removal mechanism difficult or impossible to install, rendering the removal tool ineffective. The subsidence underground can also jam the intermediate floor in place, making its removal difficult or impossible.

Thus, there remains a need for crypt closure lid that accounts for subsidence and permits the lid to be easily and safely removed. There is a further need for an intermediate privacy partition that can be as easily removed. The present invention is directed to this shortcoming in the art.

SUMMARY OF THE INVENTION

The present invention provides a crypt lid with lifting means for applying a vertical force to lift the lid. In a preferred embodiment, the lid is cast of concrete with one or more lifting holes extending vertically through the lid. The holes may be lined with a corrosion resistant material, such as a hard plastic, PVC, or other suitable material. The lining is preferably threaded, and sealing plug is adapted for threaded engagement with the lining of the holes. The plug is provided with a recessed drive receptacle and preferably fits flush with the surface of the crypt lid. This feature prevents damage to the plug, the lining, or the lid itself when a crypt is exhumed with heavy machinery like a backhoe.

Other lifting structures are also shown in the following detailed description and are fully within the scope and spirit of the invention.

The present invention further includes a privacy partition. The partition is preferably formed in two interdigitating halves which are quickly and easily separated from one another to expedite removal of the partition from the vault.

These and other features and advantages of this invention will be apparent to those skilled in the art from a review of the following description along with the accompanying drawings.

DETAILED DESCRIPTION OF PREFERRED EMBODIMENTS

Figure 1:
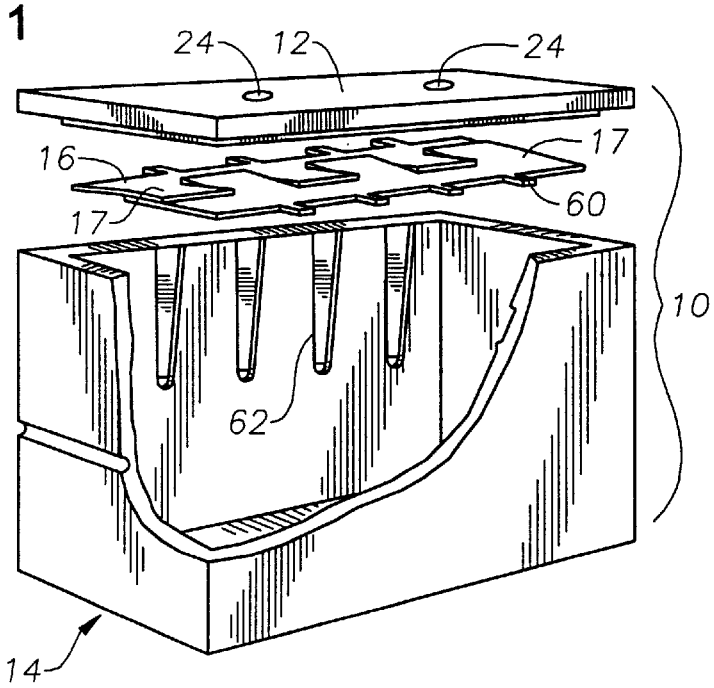
FIG. 1 is a partially broken away perspective view of a preferred embodiment of the present invention.

FIG. 1 shows a preferred embodiment of a burial crypt 10 of the invention. The principle components of the improved burial crypt 10 include a lid 12, a box 14, and a partition 16. The lid is preferably cast concrete with a pair of lifting holes 24 cast in place when the lid is formed. The partition 16 is formed as a complementary pair of mating halves 17, with mating tabs and slots described in more detail below. The partition 16 also defines a plurality of tabs 60 which fit within grooves 62 to guide the partition 16 into place.

Figure 2A:
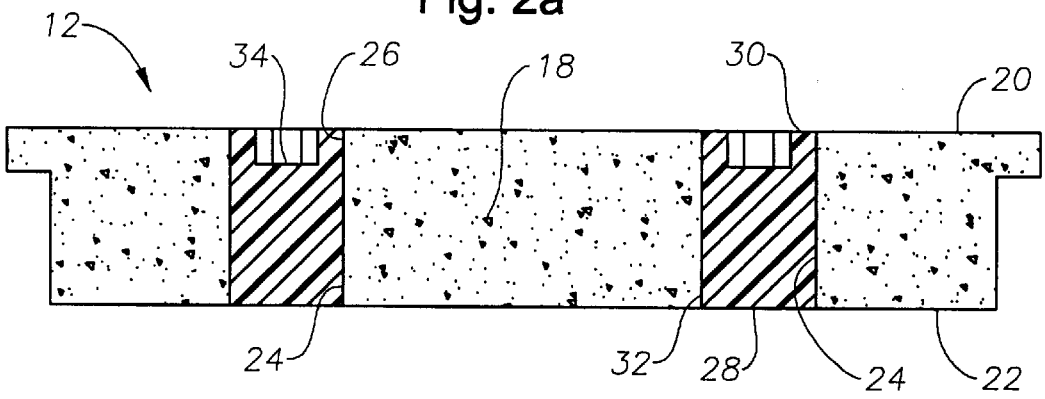
FIG. 2*a* is a front sectional view of a first preferred embodiment of the lid shown in FIG. 1.

FIG. 2*a* shows a first preferred embodiment of the lid 12 shown in FIG. 1. The lid 12 comprises a slab 18. The slab 18 is generally made from concrete, but one may use most any material that is strong, durable, and resistant to corrosion and decay. Reinforcement bars (not shown) may be incorporated into the slab 18 to increase strength. The slab 18 has an exterior surface 20 and an interior surface 22. The exterior surface 20 is the top-most surface of the slab 18. The exterior surface 20 is exposed to the environment and is ordinarily nearest the ground surface when the crypt 10 is buried. The interior surface 22 defines the lower limit of the slab 18 and also forms the upper boundary to the interior volume of the box 14. The distance between the exterior surface 20 and the interior surface 22 defines the thickness of the slab 18.

The lid 12 shown in FIG. 2*a* further comprises two holes 24 extending from the exterior surface 20 toward the interior surface 22. The holes 24 pass through the entire thickness of the slab 18. The holes 24 are bounded by inner boundary surfaces 26 of the slab 18. While the first preferred embodiment of FIG. 2*a* shows a slab 18 with two holes 24, more or fewer holes 24 may be used. The holes 24 are adapted to receive a lifting tool 80 (shown in FIG. 5). The lifting tool could be as simple as a piece of angled iron or something more elaborate such as a "Molybolt"-type expansion fitting. The lifting tool is inserted into the hole 24 and applies a lifting force bearing on the interior surface 22 of the slab 18. While a proper lifting tool could safely lift a lid 12 having only one hole 24, multiple holes 24 offer better stability and load distribution. Three or four holes 24 would provide more stability and load distribution than two holes 24, but the larger number of holes 24 would also increase the labor involved in preparing to lift the lid 12. The greater number of holes 24 also increases the complexity and expense of manufacture. The two holes 24 in the first preferred embodiment of FIG. 2*a* represent a reasonable compromise among competing factors.

The lid 12 further comprises a plug 28 adapted to fit into and substantially fill each hole 24. The plug 28 has an upper surface 30 and an outer surface 32. The outer surface 32 of the plug 28 is placed in intimate contact with the inner boundary surface 26 of the slab 18. The plug 28/slab 18 interface is sufficiently tight to form a seal, preventing the invasion of soil and moisture into the interior region of the box 14. The plug 28 should be made of material that is strong, durable, and resistant to corrosion and decay. It is desirable, although not required, that the plug 28 also be machinable, or the plug may preferably be molded. A material such as a hard plastic is a good choice for the plug 28. The plug 28 may be placed so that its upper surface 30 is flush with the exterior surface 20 of the slab 18 so that the plug 28 is less likely to be broken during excavation. The plug 28 may be a disposable insert or removably attached to the slab 18. If the plug 28 is removably attached, the upper surface 30 of the plug 28 should have a recess 34 adapted to receive a tool to allow easy extraction. The recess 34 reduces the profile of the plug 28, making it easier to set the plug 28 so that its upper surface 30 is flush with the exterior surface 20 of the slab 18. The recess 34 is preferably a hexagonal recess to receive a standard hex-type allen wrench for ease of removal of the plug 28.

Figure 2B:
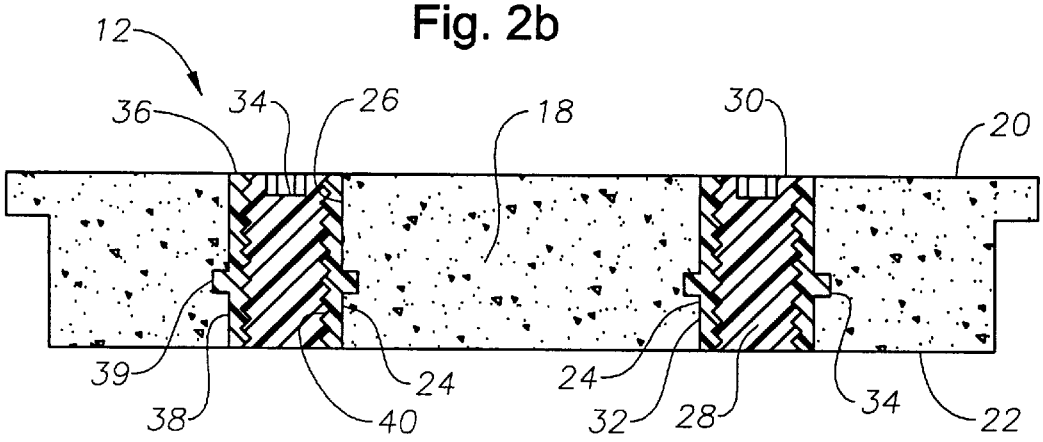
FIG. 2*b* is a front sectional view of a second preferred embodiment of the lid shown in FIG. 1.

FIG. 2*b* shows a second preferred embodiment of the lid 12 shown in FIG. 1. The second preferred embodiment comprises all the elements of the first preferred embodiment shown in FIG. 2*a*. The second preferred embodiment further comprises a hole 24 that is lined with a sleeve 36. Like the plug 28, the sleeve 36 should be made of material that is strong, durable, and resistant to corrosion and decay. It is desirable, although not required, that the sleeve 36 also be machinable, but as with the plug, the sleeve may preferably be molded. A material such as a hard plastic is a good choice for the sleeve 36. The sleeve 36 has an outer surface 38 and an inner surface 40. The outer surface 38 is placed in intimate contact with the inner boundary surface 26 of the slab 18. The outer surface 38 of the sleeve 36 may be faceted or given a rough finish to inhibit rotation relative to the slab 18, and may be set in place during manufacture of the slab 18. Alternatively, the outer surface 38 may include an annular ring 39 with a hexagonal outer perimeter for this purpose. The inner surface 40 of the sleeve 36 may be smooth or threaded, but is preferably threaded to receive complementary threads on the exterior surface of the plug 28.

The plug 28 used in the second preferred embodiment of the lid 12 is essentially identical to that of the first preferred embodiment of FIG. 2*a*. However, because the hole 24 is now lined, there are slight differences in configuration. In the second preferred embodiment, the plug 28 is placed in intimate contact with the inner surface 40 of the sleeve 36. The outer surface 32 of the plug 28 may be smooth or threaded to mate with the threaded inner surface 40 of the sleeve 36. The plug 28/sleeve 36 interface is sufficiently tight to form a seal, preventing the invasion of soil and moisture into the interior region of the box 14. The plug 28 is preferably placed so that its upper surface 30 is flush with the exterior surface 20 of the slab 18. The plug 28 may be a disposable insert or removably attached to the sleeve 36. If the plug 28 is removably attached, the upper surface 30 of the plug 28 should have a recess 34 adapted to receive a tool to allow easy extraction. The recess 34 reduces the profile of the plug 28, making it easier to set the plug 28 so that its upper surface 30 is flush with the exterior surface 20 of the slab 18.

Figure 2C:
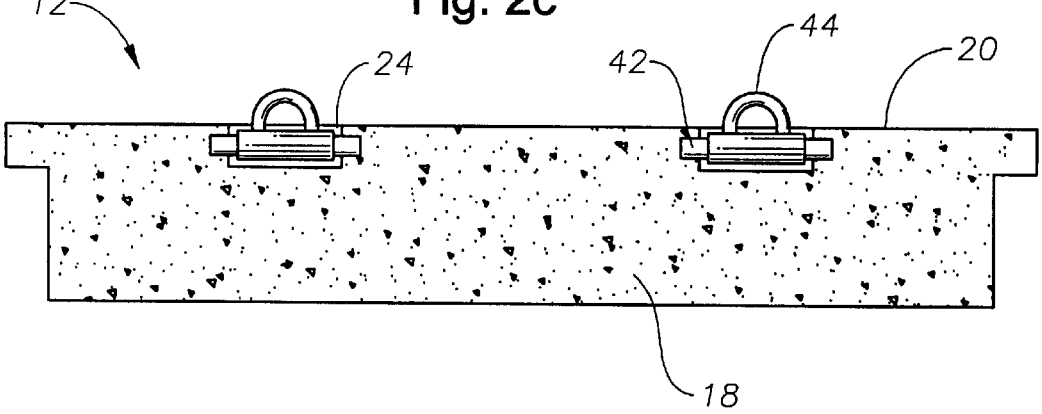
FIG. 2*c* is a front sectional view of a third preferred embodiment of the lid shown in FIG. 1.

FIG. 2*c* shows a third preferred embodiment of the lid 12 shown in FIG. 1. This version comprises the slab 18 and the holes 24, but the holes 24 do not extend through the entire thickness of the slab 18. Instead, the holes 24 are adapted to receive a hinge pin 42 and a hook 44. The hinge pin 42 is fixed in the slab 18 such that it spans the hole 24 in the interior region of the hole 24. That is, the hinge pin 42 is mounted a short distance below the exterior surface 20 of the slab 18. The hook 44 is pivotally attached to the hinge pin 42. The hole 24 is sized to accommodate the hinge pin 42 and hook 44, preferably so that the hook 44 lies essentially flat within the interior region of the hole 24 when not being used to lift the lid 12. By lowering the profile of the hook 44 and hinge pin 42 below the level of the exterior surface 20 of the slab 18, the hook 44 and hinge pin 42 are less likely to be broken during excavation.

Figure 3A:
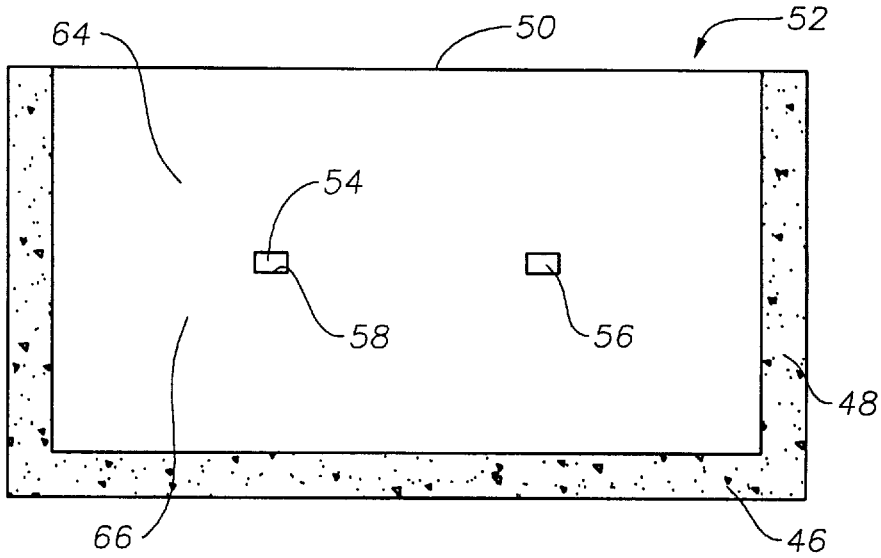
FIG. 3*a* is a front sectional view of the first preferred embodiment of the box shown in FIG. 1 without guide grooves.

FIG. 3*a* shows a front section view of a first preferred embodiment of the box 14 of FIG. 1. The box comprises a bottom 46, a pair of opposing spaced end walls 48, and a pair of opposing spaced side walls 50 forming an enclosure having an open top 52. Each side wall 50 of the box 14 has two recesses 54 at a predetermined location 56. Each recess 54 provides a stop 58 engaged by an outer tab 60 (shown in FIG. 4) of the partition 16.

Figure 3B:
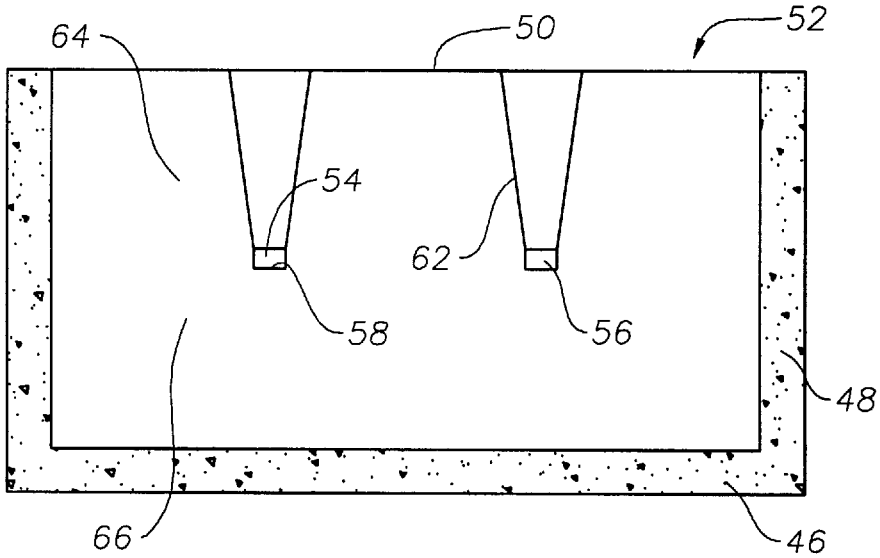
FIG. 3*b* is a front sectional view of a second preferred embodiment of the box shown in FIG. 1 with guide grooves.

FIG. 3*b* shows a second preferred embodiment of the box 14 of FIG. 1. This version comprises all the elements of the first preferred embodiment shown in FIG. 3*a*, but each side wall 50 further comprises two or more spaced guide grooves 62 extending down from the top 52 of the enclosure toward the bottom 46 of the box 14 and terminating at the predetermined location 56. Each guide groove 62 has a closed end providing a stop 58 engaged by an outer tab 60 (shown in FIG. 4) of the partition 16.

Figure 4:
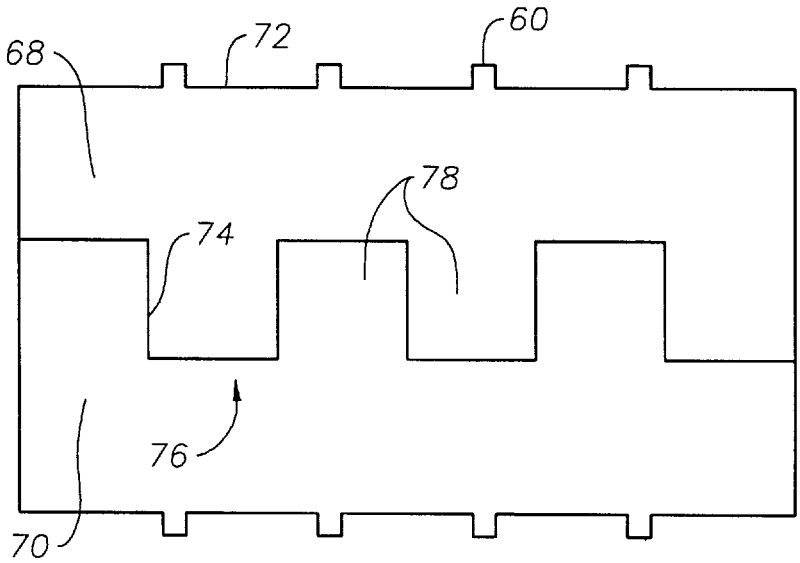
FIG. 4 is a top plan view of a preferred embodiment of the partition shown in FIG. 1.

FIG. 4 shows a preferred embodiment of the partition 16 of FIG. 1. The partition 16 is placed in the box 14 at the predetermined location 56 between the top 52 of the enclosure and the bottom 46 of the box 14, dividing the box 14 into an upper chamber 64 and a lower chamber 66. The partition 16 comprises a first panel 68 and a second panel 70. Each panel 68 and 70 has an outside edge 72 and an inside edge 74. Each outside edge 72 has two or more spaced projecting outer tabs 60 that engage the recesses 54 in each side wall 50 when the partition 16 is placed in the box 14 at the predetermined position 56. If the box 14 has guide grooves 62, the grooves 62 are used to align the outer tabs 60 of the panels 68 and 70 while lowering the partition 16 to the predetermined position 56. Each inside edge 74 has an alternating series of notches 76 and inner tabs 78. The notches 76 and inner tabs 78 of the first panel 68 are offset from the notches 76 and inner tabs 78 of the opposing second panel 70 to allow the inner tabs 78 of the first panel 68 to intermesh with the notches 76 of the second panel 70. Similarly, the inner tabs 78 of the second panel 70 intermesh with the notches 76 of the opposing first panel 68. Thus, the panels 68 and 70 overlap, forming an interlocking, collapsible partition 16. The recesses 54 or guide grooves 62 work in cooperation with the outer tabs 60 of each panel 68 and 70 to support the partition 16. Better support can be obtained by using more than two recesses 54 or guide grooves 62 in each side wall 50. Thus, the side walls 50 and panels 68 and 70 can be mutually modified to increase the support of the partition 16. Also, the tabs 60 on one side of the partition are offset from the tabs 60 on the opposite side of the partition so that the partition can be turned by 180° and still fit into the aligning grooves, and for greater strength of the partition.

Figure 5:
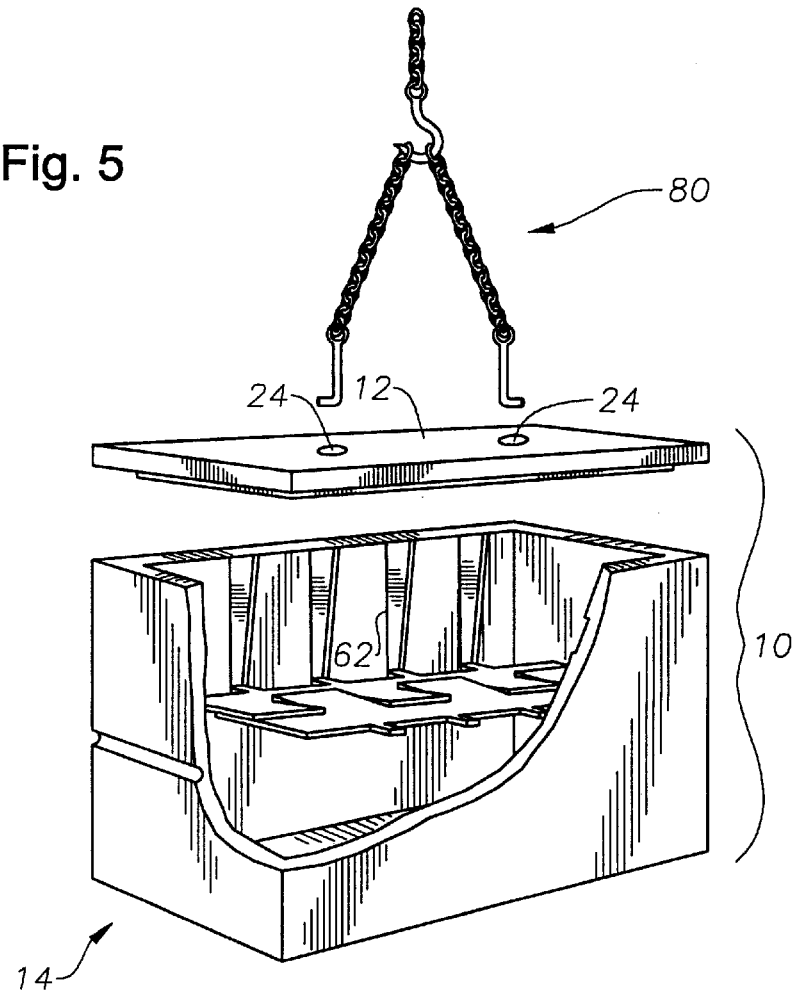
FIG. 5 is a perspective view of the crypt and lid of the invention showing the lifting mechanism in operation.

Finally, FIG. 5 shows a preferred embodiment of the invention using a lifting mechanism 80. The lifting mechanism includes an angle member 82, one such member 82 for each hole provided. The member 82 is coupled to a chain or wire 84 or other coupling means. The chain 84 is removably joined to a hook 86 which is attached to a lifting crane or backhoe or other machine with lifting capability (not shown) to lift the lid 12 off of the crypt. As previously described, the angle member 82 may be replaced by a molybolt for even greater security in lifting.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A lid for a burial crypt comprising:

a slab, the slab having a thickness defined by the distance between an exterior surface of the slab and an interior surface of the slab;

at least one hole in the slab extending through the entire thickness of the slab, the hole adapted to receive a lifting tool; and a plug filling the hole, the plug having an upper surface and an outer surface, the outer surface of the plug being in intimate contact with an inner boundary surface of the slab, the plug being removably mounted to the slab, and the upper surface of the plug being flush with the exterior surface of the slab.

2. A lid for a burial crypt comprising:

a slab, the slab having a thickness defined by the distance between an exterior surface of the slab and an interior surface of the slab;

at least one hole in the slab extending through the entire thickness of the slab, the hole adapted to receive a lifting tool and defining an inner boundary surface of the slab;

a sleeve lining the hole, the sleeve having an outer surface and an inner surface, the outer surface of the sleeve being in intimate contact with the inner boundary surface of the slab, and the inner surface of the sleeve defining a lined hole; and a plug filling the lined hole, the plug having an upper surface and an outer surface, the outer surface of the plug being in intimate contact with the inner surface of the sleeve, the plug being removably mounted to the sleeve.

3. The lid of claim 2 wherein the upper surface of the plug is flush with the exterior surface of the slab.

4. The lid of claim 3 wherein the lined hole and the plug are substantially cylindrical.

5. The lid of claim 4 wherein a. the inner surface of the sleeve is threaded; and b. the outer surface of the plug is threaded to engage the threaded inner surface of the sleeve.

6. The lid of claim 5 wherein the interior surface of the slab is a bearing surface for lifting the lid.

7. The lid of claim 6 wherein there are two holes.

8. A crypt comprising:

a box having a bottom, a pair of opposing spaced end walls, and a pair of opposing spaced side walls forming an enclosure having an open top;

a removable cover closing the open top, the cover having an exterior surface and an interior surface, a hole extending from the exterior surface to the interior surface, a sleeve bonded to and lining the hole in the cover, and a removable plug filling each sleeve;

a removable intermediate partition placed in the box at a predetermined location between the top of the enclosure and the bottom of the box, dividing the box into an upper and lower chamber, the partition comprising a pair of interlocking opposing panels, each panel having an outside edge having at least two spaced projecting outer tabs, and an inside edge having an alternating series of notches and inner tabs, the notches and inner tabs of one panel being offset from the notches and inner tabs of the opposing panel to allow the inner tabs of each panel to intermesh with the notches of the opposing panel, overlapping the opposing panel and thus interlocking the two panels;

each side wall of the box having at least two spaced guide grooves extending down from the top of the enclosure toward the bottom of the box and terminating at the predetermined location;

each guide groove being offset from a corresponding guide groove in the opposite side wall and each guide groove having a flat, closed end providing a stop engaged by the outer tab to support the partition.

9. The crypt of claim 8, wherein a. there are two holes in the cover;

b. the holes are cylindrical;

c. each of the sleeves lining the cylindrical holes is threaded; and d. each of the removable plugs is threaded to mate with the threaded sleeves.

10. The crypt of claim 9, wherein a. each hole is adapted to receive a lifting tool attachment; and b. the interior surface of the cover is a bearing surface for lifting the cover.

* * * * *